US010597973B2

(12) United States Patent
Pickle

(10) Patent No.: US 10,597,973 B2
(45) Date of Patent: Mar. 24, 2020

(54) ACTIVATING A DOWNHOLE TOOL WITH SIMULTANEOUS PRESSURE FROM MULTIPLE CONTROL LINES

(71) Applicant: Halliburton Energy Services, Inc., Houston, TX (US)

(72) Inventor: Brad Richard Pickle, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/744,434

(22) PCT Filed: Dec. 8, 2016

(86) PCT No.: PCT/US2016/065657

§ 371 (c)(1),
(2) Date: Jan. 12, 2018

(87) PCT Pub. No.: WO2018/106246

PCT Pub. Date: Jun. 14, 2018

(65) Prior Publication Data

US 2018/0371870 A1 Dec. 27, 2018

(51) Int. Cl.

| | |
|---|---|
| ***E21B 34/10*** | (2006.01) |
| ***E21B 34/06*** | (2006.01) |
| ***E21B 34/16*** | (2006.01) |

(52) U.S. Cl.

CPC ..... *E21B 34/10* (2013.01); *E21B 34/063* (2013.01); *E21B 34/103* (2013.01); *E21B 34/16* (2013.01)

(58) Field of Classification Search

CPC ..... E21B 34/06; E21B 34/10; E21B 34/16
See application file for complete search history.

(56) References Cited

U.S. PATENT DOCUMENTS

| | | | | |
|---|---|---|---|---|
| 4,566,540 | A | 1/1986 | Pringle et al. | |
| 2009/0050333 | A1 | 2/2009 | Smith et al. | |
| 2009/0229834 | A1 | 9/2009 | Bolding et al. | |
| 2014/0096978 | A1* | 4/2014 | Giusti, Jr. | E21B 34/06 166/386 |
| 2018/0202261 | A1* | 7/2018 | Scott | E21B 34/106 |

FOREIGN PATENT DOCUMENTS

WO 2011072047 A2 6/2011

* cited by examiner

*Primary Examiner* — Caroline N Butcher
(74) *Attorney, Agent, or Firm* — Scott Richardson; Parker Justiss, P.C.

(57) ABSTRACT

A method of hydraulically actuating downhole equipment includes supplying pressure P(z) to a downhole network comprising tools T(n), tool T(x), control lines C(z), and control lines Y(z), wherein n and z are integers, and x=n+1, wherein a pressure P(z) is applied to tool T(n) using at least one control line C(z) in hydraulic communication with tool T(n); applying pressure P(z) to a hydraulically movable portion of tool T(n), wherein pressure P(z) to tool T(n) is not high enough to independently activate tool T(x); and applying each pressure P(z) to a hydraulically movable portion of tool T(x), wherein tool T(x) is only activated when all of pressures P(z) are simultaneously applied to the hydraulically movable portion of tool T(x), and wherein tool T(x) is only activated when each pressure P(z) is at least at a preset value PV(z).

11 Claims, 5 Drawing Sheets

ACTIVATING A DOWNHOLE TOOL WITH SIMULTANEOUS PRESSURE FROM MULTIPLE CONTROL LINES

CROSS-REFERENCE TO RELATED APPLICATION

This application is the National Stage of, and therefore claims the benefit of, International Application No. PCT/US2016/065657 filed on Dec. 8, 2016, entitled "ACTIVATING A DOWNHOLE TOOL WITH SIMULTANEOUS PRESSURE FROM MULTIPLE CONROL LINES". Both of the above applications are commonly assigned with this National Stage application and are incorporated herein by reference in their entirety.

BACKGROUND

In oil and gas wells, it is common to conduct well testing and stimulation operations to determine production potential and enhance that potential. For example, hydraulically operated downhole tools have been developed which operate responsive to pressure differentials in the wellbore that can sample formation fluids for testing or circulate fluids therethrough. These tools typically incorporate both a ball valve and lateral circulation ports. Both the ball valve and circulation ports are operable between open and closed positions. Commonly, these tools are capable of operating in different modes such as a drill pipe tester valve, a circulation valve and a formation tester valve, as well as providing its operator with the ability to displace fluids in the pipe string above the tool with nitrogen or another gas prior to testing or retesting. A popular method of employing the circulating valve is to dispose it within a wellbore and maintain it in a well test position during flow periods with the ball valve open and the circulation ports closed. At the conclusion of the flow periods, the tool is moved to a circulating position with the ports open and the ball valve closed.

To actuate such hydraulically actuated well tools, a hydraulic control system is typically used. In certain installations, the hydraulic control system has been positioned at the surface. It has been found, however, that it is uneconomical to run the required hydraulic control lines from the surface to each of the hydraulically actuated well tools for well testing.

Therefore, a need has arisen for an improved hydraulic control system for actuating downhole tools that minimizes the number of hydraulic control lines running from the surface to the hydraulically actuated well tools.

BRIEF DESCRIPTION OF THE DRAWINGS

The following figures are included to illustrate certain aspects of the present invention, and should not be viewed as exclusive embodiments. The subject matter disclosed is capable of considerable modification, alteration, and equivalents in form and function, as will occur to one having ordinary skill in the art and having the benefit of this disclosure.

DETAILED DESCRIPTION

Figure 1:
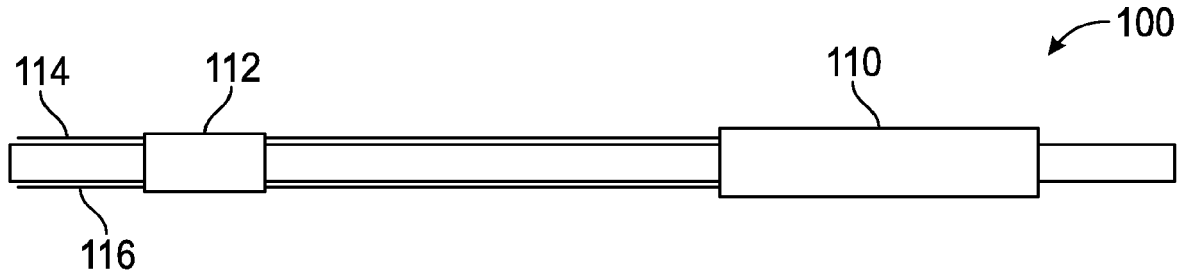
FIG. 1 is a schematic of a downhole installation with a dual line safety valve and landing nipple according to embodiments of the disclosure.

The disclosure is generally directed to methods for hydraulically activating downhole tools when a predetermined activation pressure is applied to multiple control lines simultaneously.

In an embodiment, a method of hydraulically actuating downhole equipment comprises: supplying pressure P(z) to a downhole network comprising tools T(n), tool T(x), control lines C(z), and control lines Y(z), wherein n and z are integers, and x=n+1, wherein a pressure P(z) is applied to tool T(n) using at least one control line C(z) in hydraulic communication with tool T(n), and each pressure P(z) is further applied to tool T(x) using control lines Y(z) in hydraulic communication with tool T(x); applying pressure P(z) to a hydraulically movable portion of tool T(n), wherein pressure P(z) to tool T(n) is not high enough to independently activate tool T(x); and applying each pressure P(z) to a hydraulically movable portion of tool T(x), wherein tool T(x) is only activated when all of pressures P(z) are simultaneously applied to the hydraulically movable portion of tool T(x), and wherein tool T(x) is only activated when each pressure P(z) is at least at a preset value PV(z).

In an embodiment, a method of hydraulically actuating downhole equipment comprises: applying pressure P(z) to locking device L(z) coupled to hydraulically movable portion H(n) of a tool T, wherein n and z are integers, pressure P(z) is applied to L(z) using at least one control line C(z) in hydraulic communication with L(z), hydraulically movable portion H(n) does not independently activate tool T, and locking device L(z) is only unlocked when pressure P(z) is at least preset value PV(z); and unlocking at least one locking device L(z), wherein tool T is only activated when each locking device L(z) is in an unlocked state, thereby activating tool T.

A method of hydraulically actuating downhole equipment comprises: supplying pressure P(z) to a downhole network comprising tool T(n), tool T(x), control lines C(z), and control lines Y(z), wherein n, x, and z are integers, and pressure P(z) is applied to tool T(n) using at least one control line C(z) in hydraulic communication with tool T(n), and pressure P(z) is applied to tool T(x) using at least one control line C(z) in hydraulic communication with tool T(x); applying pressure P(z) to tool T(n) and tool T(x), wherein pressure P(z) is monitored by tool T(x), and pressure P(z) is not high enough to independently activate tool T(n), and pressure P(z) is not high enough to independently activate tool T(x); and applying pressure P(z) to tool T(n) and to tool T(x), wherein tool T(x) activates tool T(n) when all pressures P(z) are simultaneously applied, and when each pressure P(z) is at least a preset value PV(z). At least one tool T(x) may be a transducer and at least one tool T(n) may be a valve.

The following illustrative examples are given to introduce the general subject matter discussed here and are not intended to limit the scope of the disclosed concepts. The following sections describe various additional embodiments and examples with reference to the drawings in which like numerals indicate like elements, and directional descriptions are used to describe the illustrative embodiments but, like the illustrative embodiments, should not be used to limit the present disclosure.

Tools with Multi-Control Lines

FIG. 1 is a schematic of a downhole installation with a dual line safety valve and landing nipple according to an embodiment of the disclosure. Safety valve system 100 includes dual line safety valve 110, insert safety valve nipple 112, control line from the surface 114, and balance line from the surface 116. The control lines 114, 116 pass through safety valve landing nipple 112 uphole from the dual line safety valve 110. The safety valve landing nipple 112 may have little to no effect on the operation of the safety valve 110 until a predetermined activation pressure is applied to both control lines 114, 116 simultaneously. The application of the pressure may then activate the safety valve landing nipple 112, isolating the control lines 114, 116 from the safety valve 110 below and establishing control line communication with the safety valve landing nipple 112 so that a wireline valve, or other tool, may be installed and operated.

Figure 2A:
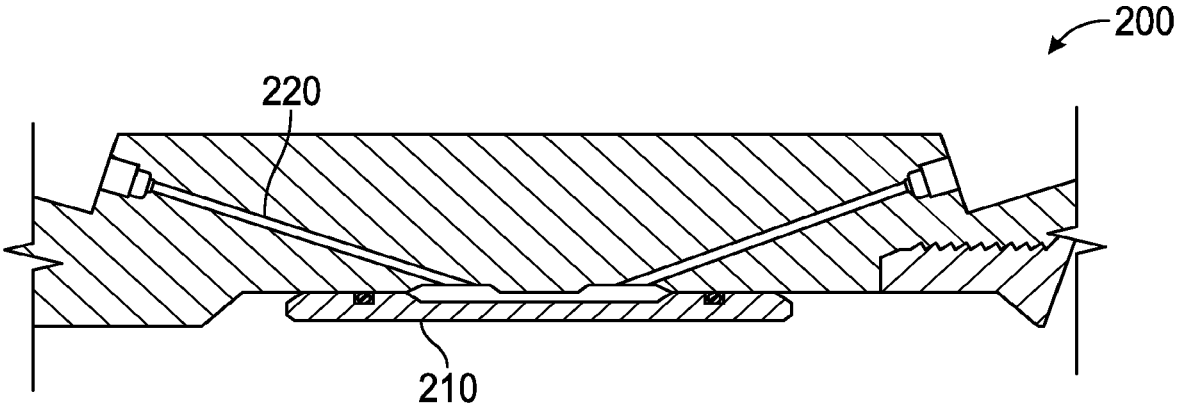
FIG. 2A is a cross-sectional view of a safety valve landing nipple in the tubing retrievable safety valve position according to embodiments of the disclosure.
Figure 2B:
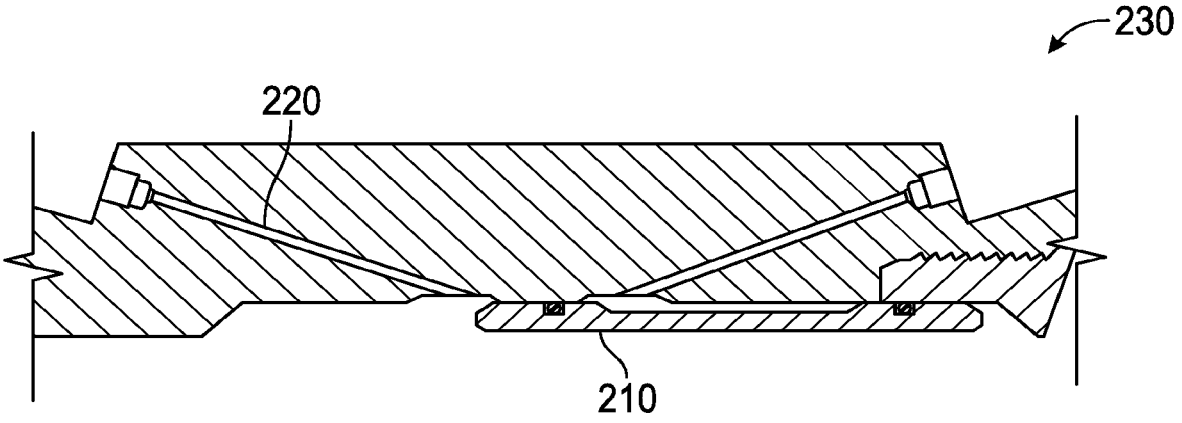
FIG. 2B is a cross-sectional view of a safety valve landing nipple in the wireline retrievable safety valve position according to embodiments of the disclosure.

A safety valve landing nipple 200, in a tubing retrievable safety valve position, may be configured as shown in FIG. 2A. A sleeve 210 may be mechanically shifted to isolate the control line 220 from a safety valve below and to provide control line 220 communication to the landing nipple 200. In FIG. 2B, a wireline retrievable configuration 230 is shown. The sleeve 210 has been shifted, thereby isolating the downstream safety valve from the control lines 220, thereby allowing a wireline valve to be installed an/or operated. FIGS. 2A and 2B illustrate only one control line of a multi control line system according to embodiments of the disclosure. In other embodiments, control lines and rod type piston(s) in the wall of the tool may switch the control line flow path rather than a sleeve on the inside diameter.

Figure 3A:
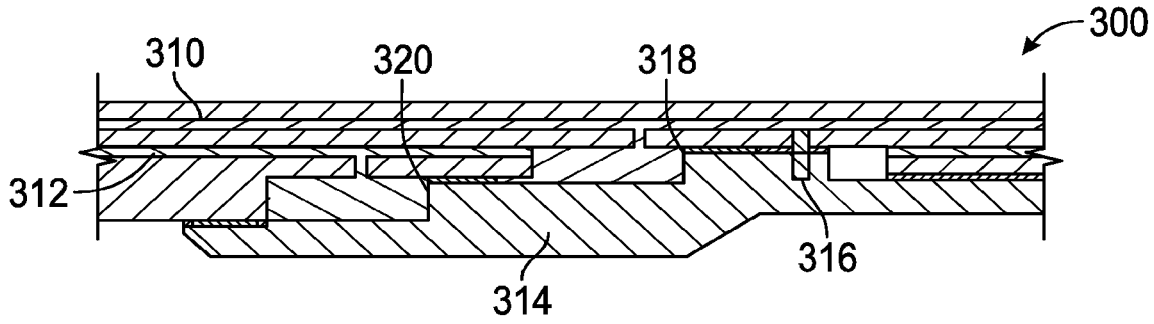
FIGS. 3A, B depict hydraulically actuating a downhole tool using two control lines and annular pistons according to embodiments of the disclosure.
Figure 3B:
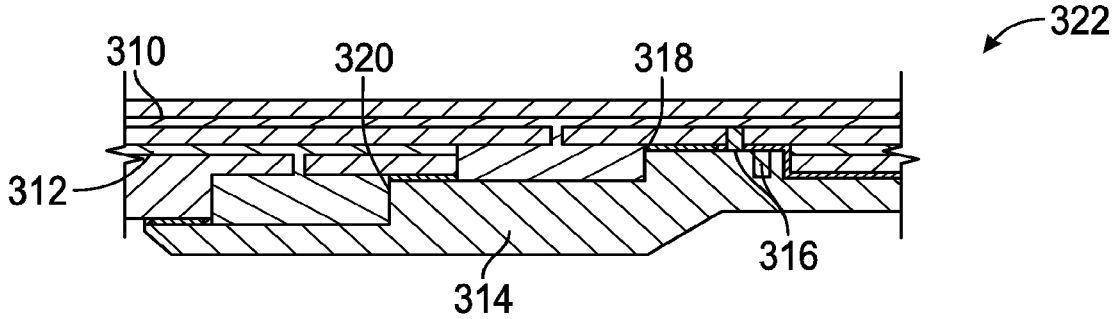

FIGS. 3A, B demonstrate the hydraulic actuation of a downhole tool 300 using two control lines 310, 312 on a shifting member 314. In this case a shear pin 316 or similar device is used to prevent the tool from shifting. The force required to shear the pin 316 and/or shift the tool is more than either control line 310, 312 is capable of producing independently because each control line 310, 312 works on an independent piston area 318, 320 and has a limited operating pressure. As demonstrated in FIG. 3B, tool 322 is activated when both control lines 310, 312 are pressured to the activation pressure, the force produced by each independent piston area 318, 320 combined is adequate to shear the pin 316 and/or shift the shifting member 314 the tool 322.

FIGS. 3A, B illustrate the use of two independent annular type piston areas. In the safety valve landing nipple example illustrated in FIGS. 1 and 2AB, FIG. 3A would illustrate the control lines passing through to the safety valve and the FIG. 3B would illustrate the shifted sleeve, isolating the safety valve below and communicating the control lines to the nipple, after application of the activation pressure to both control lines simultaneously.

Figure 4A:
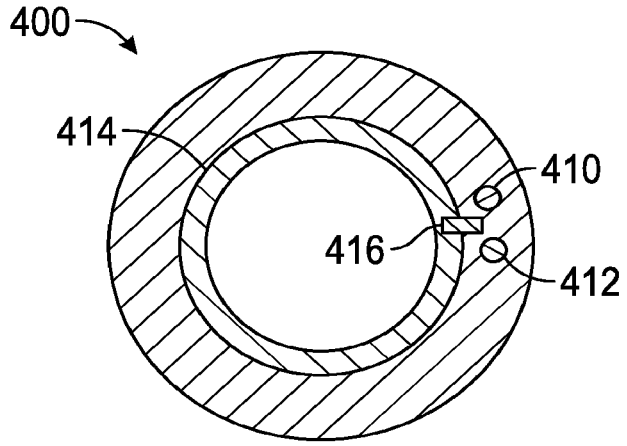
FIGS. 4A, B depict hydraulically actuating a downhole tool using two control lines and rod pistons according to embodiments of the disclosure.
Figure 4B:
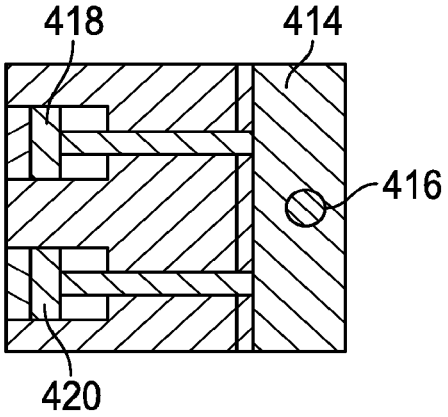

As shown in FIG. 4AB, the use of two independent rod piston type piston areas may be used to activate a tool using two control lines 410, 412 on a shifting member 414. In this case a shear pin 416 or similar device is used to prevent the tool from shifting. The force required to shear the pin 416 and/or shift the tool is more than either control line 410, 412 is capable of producing independently because each control line 410, 412 works on an independent piston area 418, 420 and has a limited operating pressure. The tool is activated when both control lines 410, 412 are pressured to the activation pressure, the force produced by each independent piston area 418, 420 combined is adequate to shear the pin 416 and/or shift the shifting member 414 the tool 400.

Figure 5A:
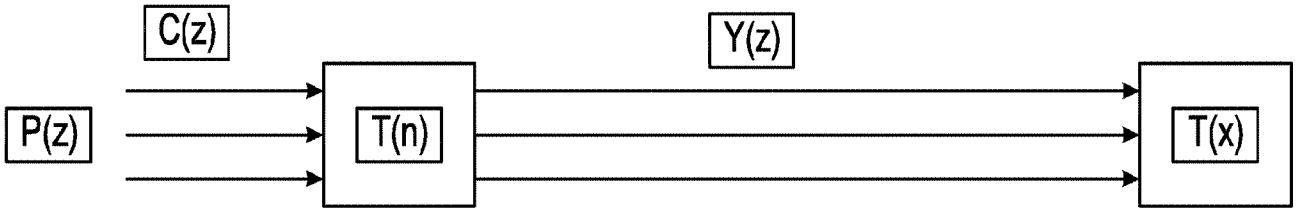
FIGS. 5A, B are schematics of multiple control lines activating multiple tools according to embodiments of the disclosure.
Figure 5B:
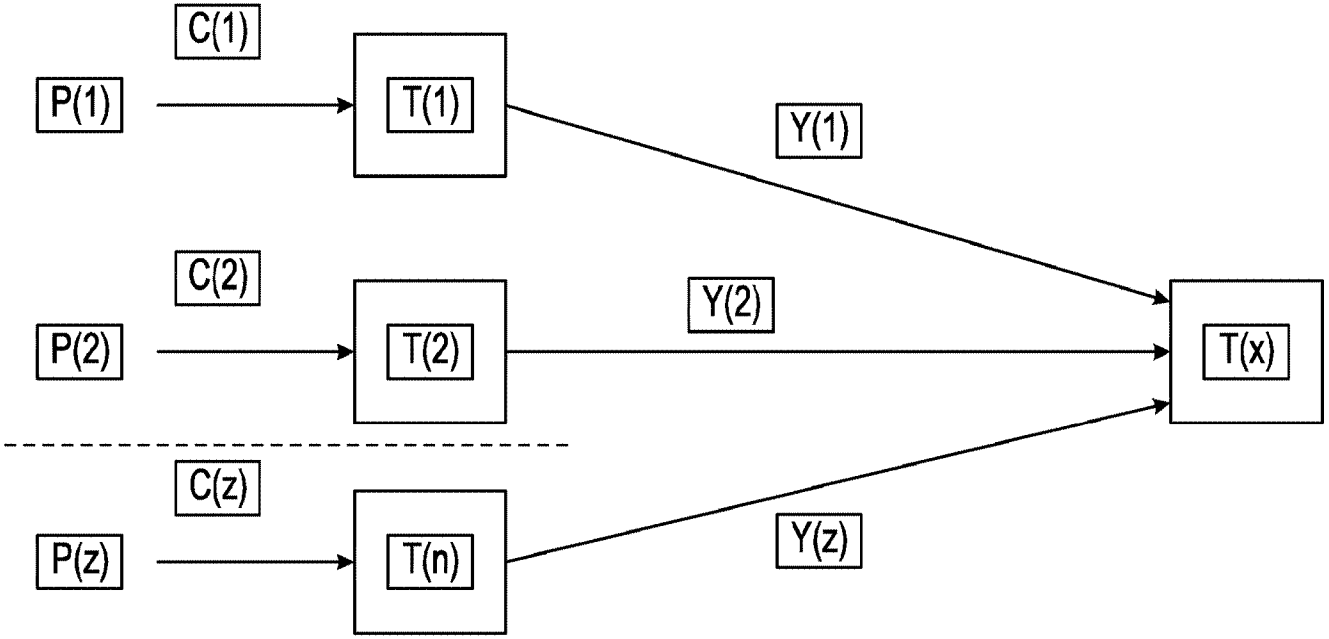

One of skill in the art will also appreciate that there can be multiple tools T(n) controlled by multiple control lines C(z) may be used to ultimately control tool T(x), where n and z are integers and x=n+1. In an embodiment as illustrated in FIGS. 5A, B, a method of hydraulically actuating downhole equipment includes supplying pressure P(z) to a downhole network comprising tools T(n), tool T(x), control lines C(z), and control lines Y(z), wherein n and z are integers, and x=n+1, wherein a pressure P(z) is applied to tool T(n) using at least one control line C(z) in hydraulic communication with tool T(n), and each pressure P(z) is further applied to tool T(x) using control lines Y(z) in hydraulic communication with tool T(x); applying pressure P(z) to a hydraulically movable portion of tool T(n), wherein pressure P(z) to tool T(n) is not high enough to independently activate tool T(x); and applying each pressure P(z) to a hydraulically movable portion of tool T(x), wherein tool T(x) is only activated when all of pressures P(z) are simultaneously applied to the hydraulically movable portion of tool T(x), and wherein tool T(x) is only activated when each pressure P(z) is at least at a preset value PV(z). FIG. 5A illustrates that each tool T(n) may have multiple control lines C(n), each with a different or the same pressure value P(z).

In an exemplary embodiment, n=1, z=2, tool T(1) is a dual control line safety valve landing nipple, and tool T(2) is a dual line safety valve, wherein tool T(1) is uphole from tool T(2). The hydraulically movable portion is a sleeve. The sleeve may be mechanically shifted to isolate control lines Y(1) and Y(2) from tool T(2), and to provide control line communication to tool T(1). The mechanically sliding sleeve may be prevented from sliding by a shear pin. The method may further comprise shearing the shear pin, thereby allowing the sleeve to mechanically shift. Each pressure P(z) may be continuously applied to the corresponding tool T(n). Further, each pressure P(z) may be continuously applied to tool T(x). The hydraulically movable portion of at least one tool T(n) may be moved by an annular piston, a rod piston, and combinations thereof. The method may further comprise lowering at least one pressure P(z) below the preset value PV(z) after the tool T(x) has been activated.

Tools with Locking Mechanisms

Figure 6:
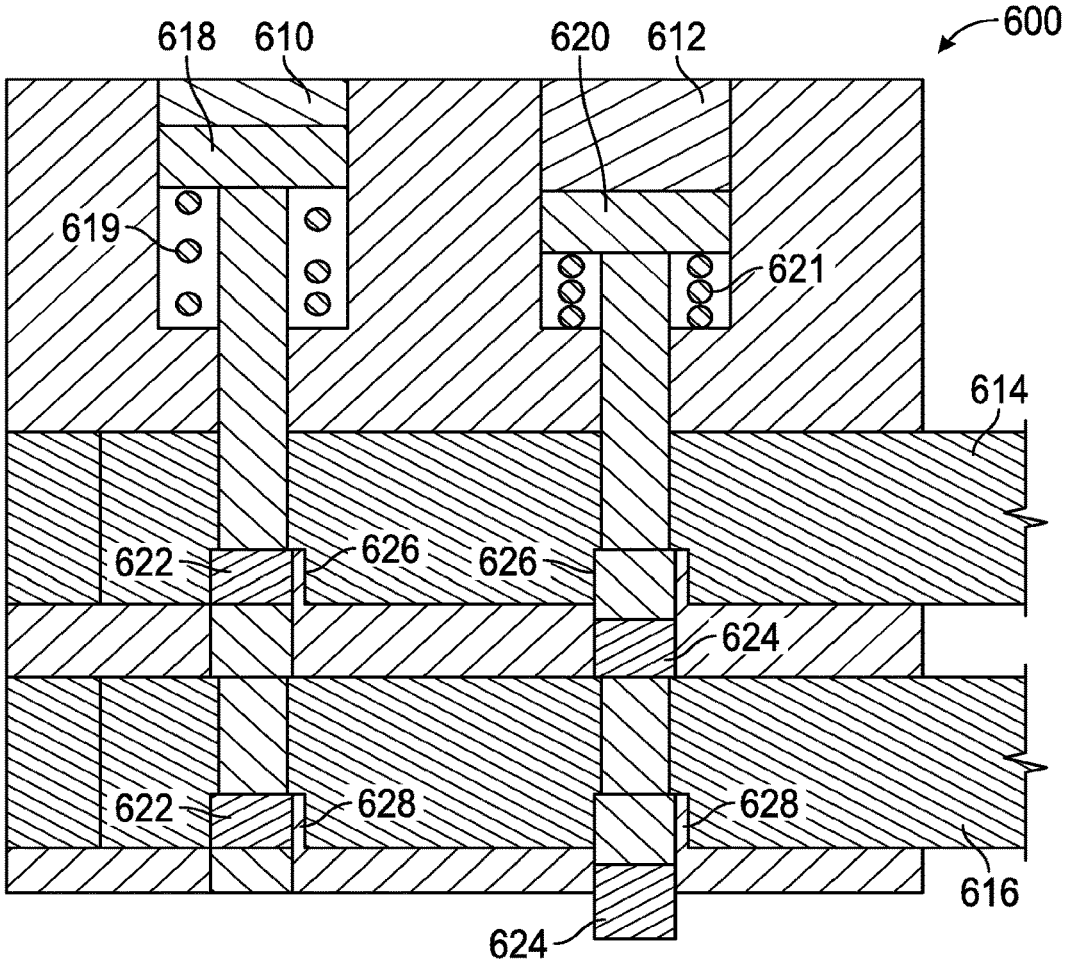
FIG. 6 is a schematic of a downhole installation with dual control lines and dual locking devices according to embodiments of the disclosure.

In an embodiment, a method of hydraulically actuating a downhole tool with locking mechanisms using simultaneous activation pressure from two control lines is demonstrated in FIG. 6. In this method the sleeve or rod piston(s) 614, 616 to be shifted (rod pistons shown here) are locked in place by lugs (622, 624) and keys, notches, dogs, etc. (626, 628) in two places on each rod 614, 616. Each lock 622, 624 is controlled independently by a single control line 610, 612. In an embodiment, a spring 619, 621 will compress when pressure on either control line 610, 612 reaches activation pressure releasing the respective locking device 622, 624. Once pressure is released from that line, the locking device will re-engage. When pressure is applied to both lines simultaneously, both locking devices will be released. This may allow the sleeve or piston rod(s) to shift to a second position. Locking device 618 is shown in the engaged position where the lugs 622 are locked into slots 626, 628 in the piston rods 614, 616. The locking device 620 is shown in the released position. Both locking devices 618, 620 need to be released prior to the piston rods 614, 616 shifting to a second position.

FIG. 6 demonstrates two locking devices controlling two piston rods. Other configurations may include at least two locking devices controlling one piston rod. In a one piston rod embodiment, at least two locking devices need to be released before the single piston rod can shift to a second position.

One of skill in the art will also appreciate that there can be multiple locking devices L(z) controlling multiple rods H(n) where n and z are integers. In an embodiment, a method of hydraulically actuating downhole equipment includes applying pressure P(z) to locking device L(z) coupled to hydraulically movable portion H(n) of a tool T, wherein n and z are integers, pressure P(z) is applied to L(z) using at least one control line C(z) in hydraulic communication with L(z), hydraulically movable portion H(n) does not independently activate tool T, and locking device L(z) is only unlocked when pressure P(z) is at least preset value PV(z); and unlocking at least one locking device L(z), wherein tool T is only activated when each locking device L(z) is in an unlocked state, thereby activating tool T.

At least one of pressure P(z) may be continuously applied to corresponding locking device L(z). Each locking device L(z) may comprise at least one of a key, a notch, a dog, and combinations thereof. Each locking device L(z) may be further coupled to at least one additional hydraulically movable portion H(n) corresponding to locking L(n) of tool T, where $n \neq z$, wherein H(n) will not move unless each locking device L(z) and L(n) is in an unlocked state. Each locking device L(z) may be returned from an unlocked state to a locked state by lowering the pressure P(z) below the preset value PV(z).

Tools with Transducers

Figure 7:
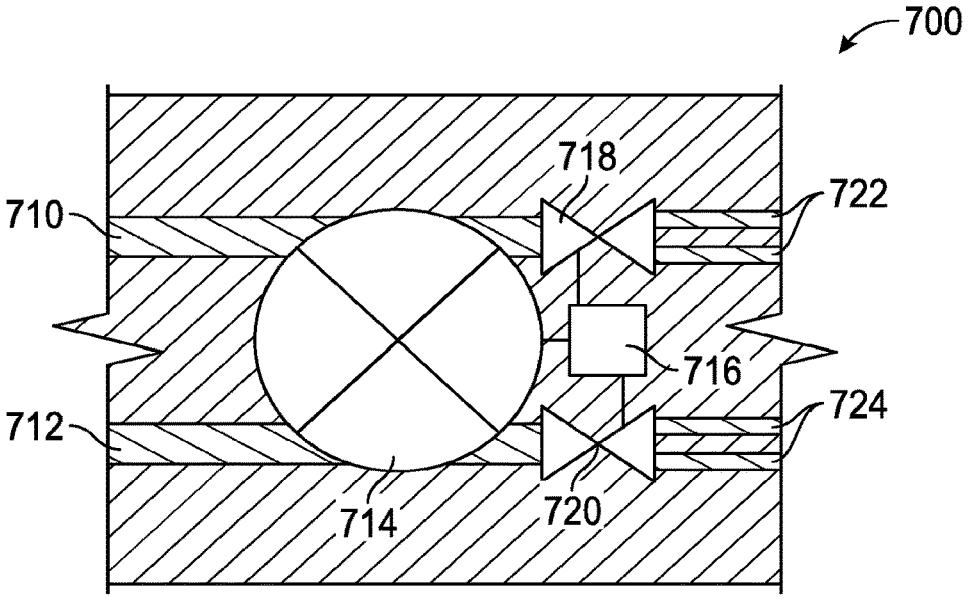
FIG. 7 is a schematic of a downhole installation utilizing dual control lines and a transducer monitor according to embodiments of the disclosure.

In an embodiment shown in FIG. 7, a method includes hydraulically actuating a downhole tool 700 using simultaneous activation pressure from two control lines 710, 712. In this method a transducer 714 monitors the pressure from each control line 710, 712. Once the transducer 714 detects the activation pressure simultaneously from both control lines 710, 712 a signal is sent to a controller 716 that actuates valves 718, 720 that, in this case, redirect the flow through of the control line fluid 722, 724 within the nipple.

Figure 8:
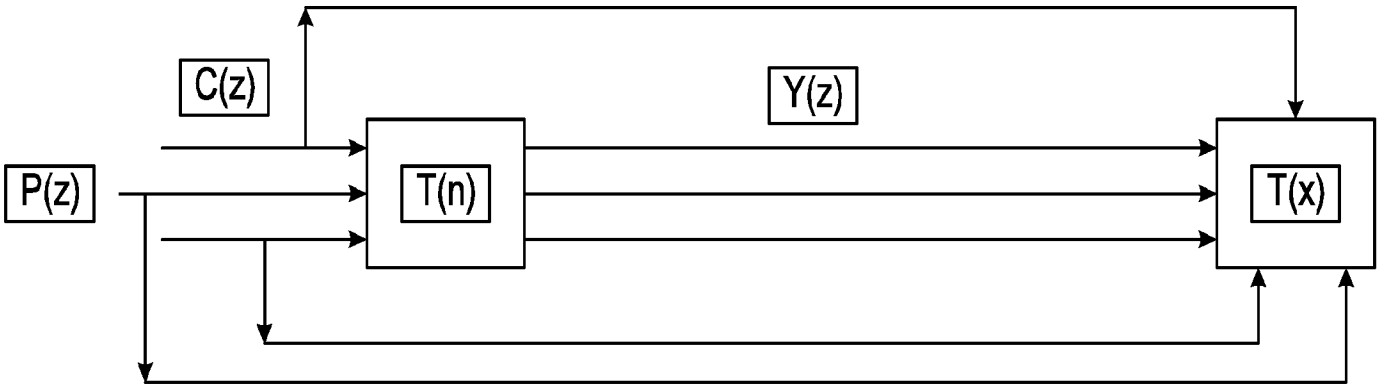
FIG. 8 is a schematic of multiple control lines activating multiple tools according to embodiments of the disclosure.

Is illustrated in FIG. 8, one of skill in the art will also appreciate that there can be multiple tools T(n) controlled by multiple control lines C(z), where tool T(n) is ultimately controlled by tool T(x), and where n, x and z are integers. The method of hydraulically actuating downhole equipment comprises: supplying pressure P(z) to a downhole network comprising tool T(n), tool T(x), control lines C(z), and control lines Y(z), wherein n, x, and z are integers, and pressure P(z) is applied to tool T(n) using at least one control line C(z) in hydraulic communication with tool T(n), and pressure P(z) is applied to tool T(x) using at least one control line C(z) in hydraulic communication with tool T(x); applying pressure P(z) to tool T(n) and tool T(x), wherein pressure P(z) is monitored by tool T(x), and pressure P(z) is not high enough to independently activate tool T(n), and pressure P(z) is not high enough to independently activate tool T(x); and applying pressure P(z) to tool T(n) and to tool T(x), wherein tool T(x) activates tool T(n) when all pressures P(z) are simultaneously applied, and when each pressure P(z) is at least a preset value PV(z). At least one tool T(x) may be a transducer and at least one tool T(n) may be a valve.

In another embodiment, the activation of at least one tool T(n) redirects the flow of a control line fluid C(z) within the valve. The method may further include lowering at least one pressure P(z) below the preset value PV(z) after the tool T(n) has been activated.

One of skill in the art will realize that the methods and assemblies according to embodiments of this disclosure have many functions and advantages, including the ability to operate a downhole tool selectively by applying pressure to at least two control lines, yet still being able to operate each control lines independently without activating the tool.

Use in Wellbore

The disclosed methods and devices may directly or indirectly affect the various downhole equipment and tools that may come into contact with the devices during operation. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components may be included in the systems generally described above and depicted in the figures, such as FIG. 1.

While preferred embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Use of the term "optionally" with respect to any element of a claim is intended to mean that the subject element is required, or alternatively, is not required. Both alternatives are intended to be within the scope of the claim.

Embodiments disclosed herein include:

A: A method of hydraulically actuating downhole equipment comprising supplying pressure P(z) to a downhole network comprising tools T(n), tool T(x), control lines C(z), and control lines Y(z), wherein n and z are integers, and x=n+1, wherein a pressure P(z) is applied to tool T(n) using at least one control line C(z) in hydraulic communication with tool T(n), and each pressure P(z) is further applied to tool x using control lines Y(z) in hydraulic communication with tool T(x); applying pressure P(z) to a hydraulically movable portion of tool T(n), wherein pressure P(z) to tool T(n) is not high enough to independently activate tool T(x); and applying each pressure P(z) to a hydraulically movable portion of tool T(x), wherein tool T(x) is only activated when all of pressures P(z) are simultaneously applied to the hydraulically movable portion of tool T(x), and wherein tool T(x) is only activated when each pressure P(z) is at least at a preset value PV(z).

B: A method of hydraulically actuating downhole equipment comprising applying pressure P(z) to locking device L(z) coupled to hydraulically movable portion H(n) of a tool T, wherein n and z are integers, pressure P(z) is applied to L(z) using at least one control line C(z) in hydraulic communication with L(z), hydraulically movable portion H(n) does not independently activate tool T, and locking device L(z) is only unlocked when pressure P(z) is at least preset value PV(z); and unlocking at least one locking device L(z), wherein tool T is only activated when each locking device L(z) is in an unlocked state, thereby activating tool T.

C: A method of hydraulically actuating downhole equipment comprising: supplying pressure P(z) to a downhole network comprising tool T(n), tool T(x), control lines C(z), and control lines Y(z), wherein n, x, and z are integers, and pressure P(z) is applied to tool T(n) using at least one control line C(z) in hydraulic communication with tool T(n), and pressure P(z) is applied to tool T(x) using at least one control line C(z) in hydraulic communication with tool T(x); applying pressure P(z) to tool T(n) and tool T(x), wherein pressure P(z) is monitored by tool T(x), and pressure P(z) is not high enough to independently activate tool T(n), and pressure P(z) is not high enough to independently activate tool T(x); and applying pressure P(z) to tool T(n) and to tool T(x), wherein tool T(x) activates tool T(n) when all pressures P(z) are simultaneously applied, and when each pressure P(z) is at least a preset value PV(z).

Each of embodiments A, B, and C may have one or more of the following additional elements in any combination: Element 1: wherein n=1, z=2, tool T(1) is a dual control line safety valve landing nipple, and tool T(2) is a dual line safety valve, wherein tool T(1) is uphole from tool T(2). Element 2: wherein tool T(1) comprises a mechanically sliding sleeve that is configured to isolate at least one control line Y(1) and Y(2) from tool T(1) to tool T(2). Element 3: wherein the sleeve is mechanically shifted to isolate control lines Y(1) and Y(2) from tool T(2), and to provide control line communication to tool T(1). Element 4: wherein the mechanically sliding sleeve is prevented from sliding by a shear pin. Element 5: further comprising shearing the shear pin, thereby allowing the sleeve to mechanically shift. Element 6: wherein each pressure P(z) is continuously applied to the corresponding tool T(n). Element 7: wherein each pressure P(z) is continuously applied to tool T(x). Element 8: wherein the hydraulically movable portion of at least one tool T(n) is moved by an annular piston. Element 9: wherein the hydraulically movable portion of at least one tool T(n) is moved by a rod piston. Element 10: further comprising lowering at least one pressure P(z) below the preset value PV(z) after the tool T(x) has been activated. Element 11: wherein at least one of pressure P(z) is continuously applied to corresponding locking device L(z). Element 12: wherein each locking device L(z) comprises at least one of a key, a notch, a dog, and combinations thereof. Element 13: wherein each locking device L(z) is further coupled to at least one additional hydraulically movable portion H(n) corresponding to locking L(n) of tool T, where n≠z, wherein H(n) will not move unless each locking device L(z) and L(n) is in an unlocked state. Element 14: wherein each locking device L(z) is returned from an unlocked state to a locked state by lowering the pressure P(z) below the preset value PV(z). Element 15: wherein at least one of tool T(n) is a valve. Element 16: wherein at least one of tool T(x) is a transducer. Element 17: wherein the activation of at least one tool T(n) redirects the flow of a control line fluid C(z) within the valve. Element 18: further comprising lowering at least one pressure P(z) below the preset value PV(z) after the tool T(n) has been activated.

Numerous other modifications, equivalents, and alternatives, will become apparent to those skilled in the art once the above disclosure is fully appreciated. It is intended that the following claims be interpreted to embrace all such modifications, equivalents, and alternatives where applicable.

The invention claimed is:

1. A method of hydraulically actuating downhole equipment, comprising:

providing a first downhole tool and a second downhole tool, two or more first control lines extending from a surface of a wellbore to the first downhole tool, and two or more second control lines extending from the first downhole tool to the second downhole tool, wherein the first downhole tool has a hydraulically movable portion comprising a single unit that is movable when subjected to a threshold pressure;

supplying a first pressure to the hydraulically movable portion comprising the single unit of the first downhole tool using one or both of the two or more first control lines, the first pressure below the threshold pressure required to slide the hydraulically movable portion comprising the single unit, and thus the first pressure continuing to the second downhole tool via one or both of the second control lines; and supplying a second greater pressure to the hydraulically movable portion comprising the single unit of the first downhole tool using at least two of the two or more first control lines, the second greater pressure at or above the threshold pressure, and thus moving the hydraulically movable portion comprising the single unit to stop at least a portion of the second greater pressure from continuing to the second tool.

2. The method as recited in claim 1, wherein the first tool is a safety valve landing nipple and the second tool is a safety valve.

3. The method as recited in claim 2, wherein the safety valve landing nipple is a dual control safety valve landing nipple having only two first control lines extending from the surface of the wellbore thereto, and further wherein the safety valve is a dual line safety valve having only two second control lines extend from the dual control safety valve landing nipple thereto.

4. The method as recited in claim 2, wherein the hydraulically movable portion comprising the single unit is a mechanically sliding sleeve that is configured to isolate at least two of the two or more first control lines from the safety valve upon moving.

5. The method as recited in claim 4, wherein the mechanically sliding sleeve is configured to isolate all of the two or more first control lines from the safety valve upon moving and provide control line communication to the safety valve landing nipple.

6. The method as recited in claim 5, wherein the mechanically sliding sleeve is prevented from moving by a shear pin, the shear pin configured to shear when the mechanically sliding sleeve is subjected to the second pressure and allow the sleeve to mechanically shift.

7. The method as recited in claim 1, wherein the moving the hydraulically movable portion comprising the single unit to stop at least a portion of the second greater pressure from continuing to the second tool, includes moving the hydraulically movable portion comprising the single unit to stop all of the second greater pressure from continuing to the second tool.

8. The method as recited in claim 1, wherein the hydraulically movable portion comprising the single unit of the first tool is moved by an annular piston.

9. The method as recited in claim 1, wherein the hydraulically movable portion comprising the single unit of the first tool is moved by a rod piston.

10. The method as recited in claim 1, wherein supplying a second greater pressure to the hydraulically movable portion comprising the single unit of the first downhole tool using at least two of two or more first control lines includes supplying a second greater pressure to the hydraulically movable portion comprising the single unit of the first downhole using all of the two or more first control lines.

11. The method as recited in claim 1, wherein moving the hydraulically movable portion comprising the single unit to stop at least a portion of the second greater pressure from continuing to the second tool includes redirecting the at least a portion of the second greater pressure to a wireline valve.

* * * * *